US007356289B2

(12) United States Patent
Itagaki et al.

(10) Patent No.: US 7,356,289 B2
(45) Date of Patent: Apr. 8, 2008

(54) IMAGE FORMING APPARATUS WITH TONER FORCED DISCHARGE MODE

(75) Inventors: Seiko Itagaki, Hachioji (JP); Hiroshi Akita, Hino (JP); Isamu Miura, Ube (JP)

(73) Assignee: Konica Minolta Business Technologies, Inc. (JP)

( * ) Notice: Subject to any disclaimer, the term of this patent is extended or adjusted under 35 U.S.C. 154(b) by 96 days.

(21) Appl. No.: 11/338,919

(22) Filed: Jan. 25, 2006

(65) Prior Publication Data

US 2006/0228125 A1 Oct. 12, 2006

(30) Foreign Application Priority Data

Apr. 6, 2005 (JP) ..... 2005-109529
Dec. 7, 2005 (JP) ..... 2005-353187

(51) Int. Cl.
*G03G 15/08* (2006.01)
*G03G 15/06* (2006.01)

(52) U.S. Cl. ..... 399/257; 399/55

(58) Field of Classification Search ..... 399/55, 399/99, 257

See application file for complete search history.

(56) References Cited

U.S. PATENT DOCUMENTS 5,162,849 A * 11/1992 Yoshino et al. ..... 399/257 X
5,768,665 A * 6/1998 Yamanaka et al. ..... 399/55 X
7,079,794 B2 * 7/2006 Forbes et al. ..... 399/257
7,095,966 B2 * 8/2006 Adachi ..... 399/27
7,177,557 B2 * 2/2007 Kreckel ..... 399/257 X

FOREIGN PATENT DOCUMENTS

| | | |
|---|---|---|
| JP | 5-224520 | 9/1993 |
| JP | 11-316490 | 11/1999 |
| JP | 2000-293023 | 10/2000 |
| JP | 2004-125829 | 4/2004 |

* cited by examiner

*Primary Examiner*—Sandra L. Brase
(74) *Attorney, Agent, or Firm*—Cantor Colburn LLP

(57) ABSTRACT

An image forming apparatus includes: a developing device which applies a developing bias voltage obtained by superimposing an AC bias voltage onto a DC bias voltage to a photoreceptor, and develops a latent image on the photoreceptor with a developer to form a toner image. The apparatus has a toner forced discharge mode for forming a toner image for forced discharge in a first image formation area provided in a non-image formation area other than a second image formation area on the photoreceptor to forcibly discharge a toner from the developing device. When the mode is selected, an AC bias voltage at a frequency lower than that in the second image formation area is applied to the first image formation area to develop a latent image for forced discharge, to form a toner image, and a toner of the toner image is collected by a cleaning device.

16 Claims, 6 Drawing Sheets

IMAGE FORMING APPARATUS WITH TONER FORCED DISCHARGE MODE

This application is based on Japanese Patent Applications Nos. 2005-109529 filed on Apr. 6, 2005 and 2005-353187 filed on Dec. 7, 2005, which are incorporated hereinto by reference.

BACKGROUND OF THE INVENTION

The present invention relates to an image forming apparatus for forming an image on a transfer material by an electrophotographic method and more particularly to an image forming apparatus for developing an image using a two-component developer.

In an example of an image forming process of forming an image by the electrophotographic method, an electrostatic latent image is formed on a photoreceptor, and the formed electrostatic latent image is developed by a developing device to form a toner image on the photoreceptor, and the formed toner image is transferred to a transfer material by a transfer device, and the transferred toner image is fixed on the transfer material by a fixing device, thus an image is formed on the transfer material. Further, in another example, the toner image on the photoreceptor is transferred to an intermediate transfer member, transferred to the transfer material from the intermediate transfer member by the transfer device, and is fixed, thus an image is formed on the transfer material.

At a developing step of the image forming process aforementioned, by using a two-component developer containing non-magnetic toner and a magnetic carrier and applying a developing bias voltage obtained by superimposing an AC bias voltage onto a DC bias voltage, the electrostatic latent image is developed.

In the developing device using the two-component developer, the toner and carrier are stirred in a developer container to frictionally charge the toner, and the toner frictionally charged is electrostatically adhered to the outer periphery of the carrier, is carried by a rotary developer carrying member having a built-in magnet, and is conveyed into a developing region, where the electrostatic latent image on the photoreceptor is developed by the charged toner.

To give the toner a charging characteristic, the surface of the toner is covered with an external additive. When printing in low image coverage which is printing at a low ratio of occupying image in printing area is increased in the number of times, the consumption amount of the toner in the developer container is reduced, and the supply efficiency of new toner is reduced, and the retention time of the toner in the developer container is prolonged. Therefore, the toner suffers stress due to stirring for a long period of time and the charging amount of the toner is reduced due to embedding of the external additive on the toner surface. Due to the reduction in the charging amount of the toner, a phenomenon such as reduction in the image quality, toner splash, or gray background appears remarkably, causing problems.

As a result of detailed examination on the reduction phenomenon of the charging amount of toner by the inventors of the present invention, it is found that the phenomenon is apt to vary with the particle diameter of the toner. It will be explained below in detail by referring to FIGS. 3 and 4.

FIGS. 3 and 4 show the charging amount distribution conditions of a developer measured by E-spart Analyzer manufactured by Hosokawa Micron, Ltd. In FIGS. 3 and 4, 2000 toner particles to be measured are divided into groups of 400 toner particles (20% of the whole) with small-particle diameters less than 4.45 μm, 1200 standard toner particles (60% of the whole) with particle diameters between 4.45 and 5.68 μm, and 400 toner particles (20% of the whole) with large-particle diameters more than 5.68 μm, and the curves indicated by Entire diameter, Small diameter, Standard diameter, and Large diameter show Q/D distributions of the whole and respective groups.

FIG. 3 shows the distribution conditions of a charging amount of Q/D (hereinafter, may be referred to as simply Q/D) per unit particle diameter of toner in the developer at start time when an image is formed by the image forming apparatus shown in FIG. 1. FIG. 4 shows the distribution conditions of Q/D after an image at a ratio of occupying image in printing area of 0.05% in low image coverage is printed 5000 times in the condition at start time shown in FIG. 3.

As clearly shown in FIGS. 3 and 4, the distribution condition of Q/D varies with the particle diameter of toner, and the reduction in Q/D of the toner on the small particle diameter side is larger, and with respect to the developer used here, in the toner on the small particle diameter side, deteriorated toner causing toner splash and image quality deterioration is apt to be generated.

Therefore, the particle diameter of toner to be developed is selective, and toner with a larger particle diameter has a better developing performance, and furthermore it depends on the size of the developing electric field. When toner with a small particle diameter whose charging amount is reduced due to the selectiveness is increased in quantity, an increase in toner splash or gray background occurs.

In Japanese Un-examined Patent Publication No. 5-224520, it is described that, in the two-color image forming method, to discharge toner charged at reverse polarity or another-colored toner mixed from the developing device, the number of revolutions of a sleeve (may be referred to as a developer carrying member) is set to a number of revolutions larger than that at time of development. However, in this case, toner splash and carrier adhesion are increased. Further, the Japanese Un-examined Patent Publication No. 5-224520 describes that the DC bias voltage at time of toner discharge is lowered, thus the developing electric field to the reverse polarity toner is made larger, and unnecessary reverse-polarity toner is much adhered to the non-image part and is discharged. The developing electric field is made larger, thus unnecessary toner is discharged. However, lowering the DC bias voltage results in making the developing electric field smaller, so that it is not appropriate to discharge toner at a low charging amount.

In Japanese Un-examined Patent Publication No. 2000-293023, a problem is described that when a blank pulse is used as a developing bias voltage, among the toner in the developer, toner with larger particle diameters is consumed much, and toner with smaller particle diameters remains in the developing unit, so that when the development is repeated, the toner particle size distribution is biased toward the smaller-particle diameter side, and the image quality is lowered such that the image density is lowered. Furthermore, it is also described that to discharge the toner with smaller-particle diameters remaining in the developing unit, at time of forced discharge, development using a rectangular pulse is repeated and toner with smaller-particle diameters is consumed much. However, the charging amount of toner is not taken into account and technical thought of discharging deteriorated toner whose charging amount is reduced is not disclosed.

In Japanese Un-examined Patent Publication No. 2004-125829, it is described that in a one-component developing device for applying a DC voltage as a developing bias voltage and developing an image, when the number of image dots at a predetermined number of revolutions of a developer carrying member is a predetermined value or smaller, the DC developing bias voltage is lowered and is set to a voltage equal to the exposure potential, and at time of other than image formation, the developer is developed from the developer carrying member onto the image carrying member, thus deteriorated toner is discharged. However, lowering the DC bias voltage results in making the developing electric field smaller, so that it is not appropriate to discharge toner at a low charging amount.

In Japanese Un-examined Patent Publication No. 11-316490, it is described that in the cleaning mode, an AC bias voltage with a small amplitude is used as a developing bias voltage having a lower developing capacity than that in the ordinary image forming mode, and the developing bias voltage is applied to develop a predetermined image, and the predetermined image is transferred to a transfer material and is discharged ont of the fixing device, thus toner at a small charging amount (weakly charged toner) can be separated from the developer in the developing unit, and a defective image due to inferior toner generated with time is prevented, and the recycling property of toner can be enhanced. However, smaller-particle diameter toner has strong adhesion force with the carrier, so that when the amplitude of the AC bias voltage is made smaller, the force for separating the toner from the carrier is weakened, thus it is difficult to discharge smaller-particle diameter toner having a small charging amount.

Patent Document 1: Japanese Un-examined Patent Publication No. 5-224520,

Patent Document 2: Japanese Un-examined Patent Publication No. 2000-293023,

Patent Document 3: Japanese Un-examined Patent Publication No. 2004-125829,

Patent Document 4: Japanese Un-examined Patent Publication No. 11-316490.

When forming an image in low image coverage, the consumption amount of toner is reduced, and the toner retention time in the developer container is prolonged, thus the time for the toner to suffer stress is prolonged, so that the charging amount of toner, particularly toner with smaller-particle diameters is lowered remarkably, and a problem of toner splash or gray background arises.

SUMMARY OF THE INVENTION

An embodiment of the present invention may provide an image forming apparatus for dissolving a problem of image quality reduction, toner splash, and gray background due to deteriorated toner whose charging amount is lowered, particularly smaller-particle diameter toner and maintaining forming images with high quality.

To solve the aforementioned problem and accomplish the above object, the present invention is structured as indicated below.

(1) An image forming apparatus comprising a photoreceptor for forming an electrostatic latent image, a developing device for applying a developing bias voltage obtained by superimposing an AC bias voltage onto a DC bias voltage to the electrostatic latent image on the photoreceptor, developing it by a two-component developer, and forming a toner image, a controller for controlling the developing bias voltage, a transfer device for transferring the toner image onto a transfer material, a fixing device for fixing the toner image to the transfer material, and a cleaning device for collecting and cleaning the toner on the surface of the photoreceptor, wherein a toner forced discharge mode for forming a toner image for forced discharge in an image formation area for forced discharge provided in a non-image formation area other than an image formation area on the photoreceptor and forcibly discharging the toner from the developing device is installed and in the toner forced discharge mode aforementioned, an AC bias voltage at a lower frequency than that in the image formation area is applied to the image formation area for forced discharge to develop a latent image for forced discharge, thus a toner image for forced discharge is formed, and the toner is collected by the cleaning device.

(2) An image forming apparatus comprising a photoreceptor for forming an electrostatic latent image, a developing device for applying a developing bias voltage obtained by superimposing an AC bias voltage onto a DC bias voltage to the electrostatic latent image on the photoreceptor, developing it by a two-component developer, and forming a toner image, a controller for controlling the developing bias voltage, a transfer device for transferring the toner image onto a transfer material, a fixing device for fixing the toner image to the transfer material, and a cleaning device for collecting and cleaning the toner on the surface of the photoreceptor, wherein a toner forced discharge mode for forming a toner image for forced discharge in an image formation area for forced discharge provided in a non-image formation area other than an image formation area on the photoreceptor and forcibly discharging the toner from the developing device is installed and in the toner forced discharge mode aforementioned, an AC bias voltage at a higher peak value than that in the image formation area is applied to the image formation area for forced discharge to develop a latent image for forced discharge, thus a toner image for forced discharge is formed, and the toner is collected by the cleaner device.

BRIEF DESCRIPTION OF THE DRAWINGS

Embodiments will now be described, by way of example only, with reference to the accompanying drawings which are meant to be exemplary, not limiting and wherein like elements are numbered alike in several FIGS. in which.

DETAILED DESCRIPTION OF THE PREFERRED EMBODIMENT

The image forming apparatus of the present invention will be explained with reference to the accompanying drawings.

Figure 1:
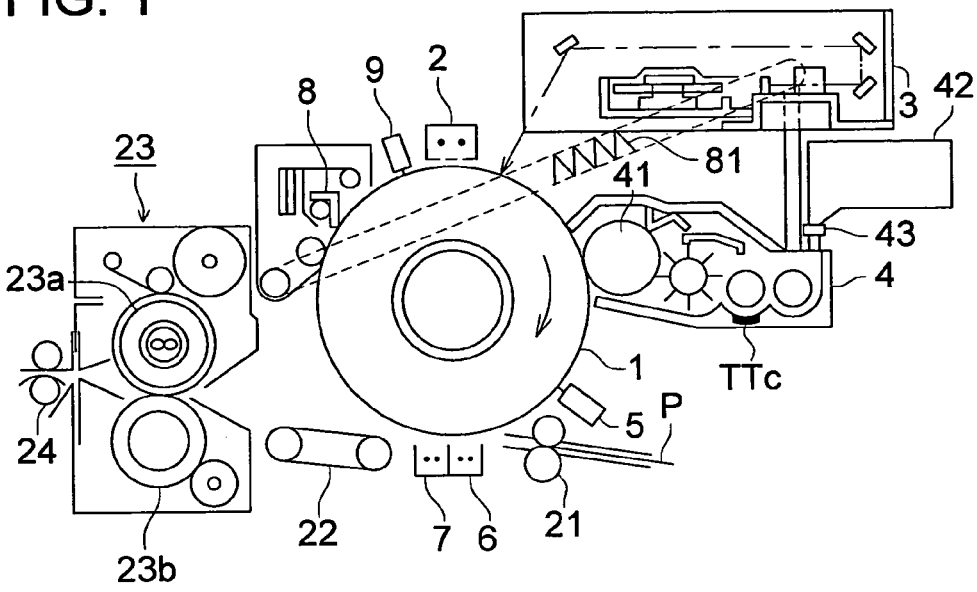
FIG. 1 is a cross sectional schematic view of the image forming apparatus.

In the image forming apparatus shown in the cross sectional schematic view in FIG. 1, an image forming unit of a copier using an electrophotographic process for forming monochromatic images to which an embodiment of the present invention is applied. However, the present invention is not limited to the constitution shown in FIG. 1 and may be applied to a color image forming apparatus.

Numeral 1 indicates a drum-shaped photoreceptor, in which an organic photosensitive layer composed of a charge generation layer in which a phthalocyanine pigment is dispersed on polycarbonate and a charge transfer layer is coated on a grounded metallic cylindrical substrate 30 μm in film thickness and the drum diameter is 80 mm. The photoreceptor is charged negatively and is driven to rotate at a peripheral speed (vp) of 280 mm/s in the direction of the arrow.

Numeral 2 indicates a charging device of a scorotron type for uniformly charging the surface of the rotary photoreceptor 1 at a potential of predetermined polarity, in which a charging electrode has a constitution that the distance between a wire and a grid is 7.5 mm, and the distance between the grid and the photoreceptor is 1 mm, and the distance between the wire and a backplate is 12 mm, and the voltage applied to the grid is 680 V, and a bias voltage for generating a charging current of −800 μA is applied, thus a charging potential Vh of the photoreceptor 1 is set to −700 V.

Numeral 3 indicates an imagewise exposure device of a laser scanning type, which uses a semiconductor laser (LD) with a wave length of 700 nm and the output power thereof is 300 μW. The imagewise exposure device 3 irradiates a laser beam and scans and exposes the surface of the photoreceptor 1 which is uniformly charged, thereby forms an electrostatic latent image.

A developing device 4 develops the electrostatic latent image on the photoreceptor 1 by a two-component developer by a developer carrying member 41 rotating while facing the photoreceptor 1, thereby forms a toner image. The development is performed by a reversible developing method in contact or non-contact using the two-component developer. The developer carrying member 41 has a constitution that an aluminum sleeve subject to a stainless steel spray coating surface process is covered around a magnet roll, and the diameter of the developer carrying member 41 is 40 mm, and the linear speed (vs) during rotation is 560 mm/s, and the ratio of linear speed to the photoreceptor 1 (vs/vp) is 2.0, and the gap between the photoreceptor and the developer carrying member is 0.3 mm. To the developer carrying member 41, a developing bias voltage obtained by superimposing an AC bias voltage at a frequency (Fac) of 5 kHz and a peak value Vacp-p of 1.0 kV to a DC bias voltage (Vdc) at a voltage of −500 V is applied and the reversible development is performed.

The two-component developer which may be used in at least an embodiment of the present invention is composed of non-magnetic toner and a magnetic carrier and the non-magnetic toner is composed of colored resin particles and an external additive.

The polymerized colored particles aforementioned are preferably polymerized colored particles with a volume mean particle diameter between 3.0 and 6.5 μm. By use of polymerized colored particles, images in which the resolution is high, and the density is stable, and gray background occurs very little can be formed.

Polymerized colored particles which may be used in at least an embodiment of the present invention are manufactured by the manufacturing method described below.

By a suspension polymerization method for uniformly suspending a polymerized composition composed of a monomer and a coloring agent in a water system medium under existence of a dispersant and then reacting polymerizably or an emulsion polymerization method for emulsifying and polymerizing a monomer to generate emulsion polymerized particles and fusing and associating the generated emulsion polymerized particles together with a coloring agent between the particles, polymerized colored particles can be manufactured. Polymerized colored particles are manufactured by uniformly dispersing a monomer in a water system medium and then polymerizing it, so that spherical polymerized colored particles in which the particle size distribution and shape are uniform can be obtained.

The polymerized colored particles which may be used in at least an embodiment of the present invention preferably have a shape factor SF-1 indicating a spherical degree from 100 to 140 and a shape factor SF-2 indicating an irregularity degree from 100 to 120. Further, the shape factors SF-1 and SF-2 are given by the formulas indicated below.

$$SF\text{-}1=(L\mathrm{max}2/A)\times(\pi/4)\times 100$$

$$SF\text{-}2=(L\mathrm{around}2/A)\times(1/4\pi)\times 100$$

where Lmax indicates a maximum diameter, Laround a peripheral length, and A a toner projected area.

The volume mean particle diameter of polymerized colored particles is preferably between 3.0 and 6.5 μm. When it is smaller than 3.0 μm, gray background and toner splash occur easily. When it is larger than 6.5 μm, high image quality may not be formed.

As an external additive which may be used in at least an embodiment of the present invention, fine particles of silica, titanium oxide, or strontium titanate may be used.

The non-magnetic toner which may be used in at least an embodiment of the present invention is manufactured by adding and mixing the aforementioned external additive with the aforementioned polymerized colored particles.

The carrier which may be used in at least an embodiment of the present invention is preferably ferrite composed of magnetic particles having a volume mean particle diameter at 25 to 45 μm and a susceptibility of 20 to 70 emu/g. In a carrier having a particle diameter of smaller than 25 μm, carrier adhesion is caused easily. Further, in a carrier having a particle diameter of larger than 45 μm, images in uniform density may not be formed.

Numeral 5 indicates a pre-transfer exposure light source for irradiating a toner image to enhance its transfer property, which is an LED with a light wave length of 700 nm and irradiates at a light output of 10 lux.

Numeral 6 indicates a transfer device of a corotron type, which has a constitution that the distance between the wire and the photoreceptor 1 is 8 mm and the distance between the wire and the backplate is 12 mm and transfers a toner image on the photoreceptor 1 to a transfer material under the constant current control of a transfer current (Itr) of 200 μA.

Numeral 7 indicates a separation electrode of a corotron type, which has a constitution that the distance between the wire and the photoreceptor 1 is 8 mm and the distance between the wire and the backplate is 12 mm and separates the transfer material from the photoreceptor 1 by a separation current of an AC component of 100 μA and a DC component of −200 μA.

A transfer material P supplied from a paper supply section is supplied in synchronization with a toner image formed on the photoreceptor 1 by registration rollers 21 and the toner image is transferred by the transfer device 6 of the transfer section. The transfer material P passing through the transfer section is separated from the surface of the photoreceptor 1 by the separation electrode 7 and is conveyed to a fixing device 23 by a conveyance belt 22.

The fixing device 23 is composed of a heat roller 23*a* having a built-in heater and a pressure roller 23*b*. The transfer material P holding the toner image is heated, pressurized, and fixed between the heat roller 23*a* and the pressure roller 23*b* and the transfer material P whose toner image is fixed is discharged onto a paper ejection tray outside the apparatus by ejection rollers 24.

On the other hand, the surface of the photoreceptor 1 after the toner image is transferred to the transfer material P is cleaned residual toner after transfer by a cleaning device 8. In this embodiment, a blade made of urethane rubber is used as a cleaning device and the cleaning blade cleans the peripheral surface of the photoreceptor 1 by sliding on the surface of the photoreceptor to contact against the rotation of the photoreceptor. The peripheral surface of the photoreceptor 1 which passes through the cleaning device 8 and is cleaned is irradiated by a pre-charge exposure device (PCL) 9 using a light source with a light wave length of 700 nm and a light output of 10 lux, and the residual potential is lowered, and the photoreceptor 1 moves to the next image forming cycle.

The toner collected by the cleaning device 8 is collected in the developing device 4 by a toner recycling device 81 for conveying toner by a conveyance screw. The collection operation into the developing device 4 is performed simultaneously with the rotation operation of the photoreceptor 1.

In the developing device 4, a toner concentration sensor TTc for detecting the toner ratio in the built-in developer is installed and when the toner is consumed by development and the toner concentration Tc is lowered to a predetermined concentration Tc0 or less, the controller opens a toner supplying port 43 and supplies toner from a toner reservoir 42 for storing new toner. Further, in this embodiment, the predetermined concentration Tc0 can vary with the environmental humidity and the times of printing, and from the humidity detected by a hygrometer installed in the apparatus and the times of printing measured by the counter, the concentration Tc0 is decided, and when the concentration detected by the concentration sensor TTc is lower than the decided concentration Tc0, toner is supplied, thus the toner concentration in the developing device 4 is adjusted.

Figure 2:
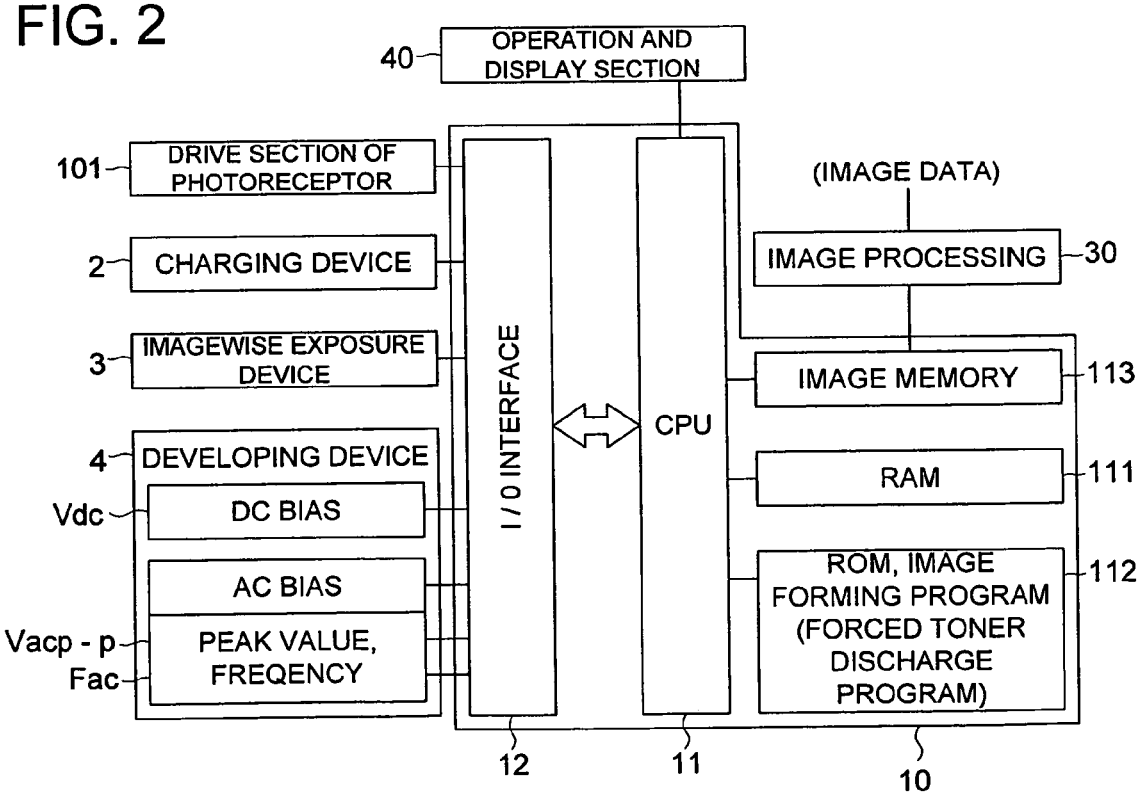
FIG. 2 is a block diagram showing the outline of the electric control system.

FIG. 2 shows the outline of the electric control system of the present invention. Numeral 10 indicates a controller and to a CPU 11 for performing a calculation control process, a RAM 111 and a ROM 112 are connected. ROM 112 stores basic calculation data and also an image forming program and in the present invention, a toner forced discharge program is incorporated in the image forming program. The toner forced discharge program is a program of switching to a developing bias condition different from the image formation area during image formation and forms and develops a toner image for forced discharge in the non-image formation area. The CPU 11 is connected to another member via an interface 12.

To the interface 12, a drive section 101 of the photoreceptor 1, the charging device 2, the imagewise exposure device 3, and the developing device 4 are connected and they are operated on the basis of a control signal from the CPU 11.

In the image forming apparatus shown in FIG. 1, an operation and display section 40 is installed and a start button for instructing start of a print operation, a size selection button for selecting a size of a transfer material, a ten-key pad for instructing the number of printed transfer materials, and an image concentration selection button for selecting an image concentration are installed.

When a user presses the start button of the operation and display section 40, the CPU 11 calls the image forming program from the ROM 112 and controls image formation according to the called program.

The CPU 11 controls the charging bias voltage power source of the charging device 2, charges the image formation area, non-image formation area, and image formation area for forced discharge on the photoreceptor 1, and charges the surface potential Vh of the photoreceptor 1. In this embodiment, Vh=−700 V.

The CPU 11 reads image information processed by image processor 30 and recorded in an image memory 113, exposes an image in the image formation area on the photoreceptor 1 by the imagewise exposure device 3, and forms an electrostatic latent image on the image. Further, for the image formation area for forced discharge installed in the non-image formation area other than the image formation area on the photoreceptor 1, the CPU 11, according to the toner forced discharge program, exposes by the imagewise exposure device so as to form an electrostatic latent image at a predetermined ratio of occupying image in printing area.

The electrostatic latent images formed in the image formation area and image formation area for forced discharge on the photoreceptor 1 are developed to toner images by the developing device 4. At this time, the CPU 11, for the image formation area on the photoreceptor 1, develops at a developing bias voltage obtained by superimposing an AC bias voltage at a peak value of Vacp-p and a frequency of Fac to a DC bias voltage Vdc. The developing bias voltages in the image formation area of the present invention are Vdc=−300 to −700 kV and Vacp-p=0.8 to 1.0 kV at Fac=5 to 7 kHz. In the embodiment which will be described later, the developing bias voltages in the image formation area are Vdc=−500 V and Vacp-p=1.0 kV at Fac=5 kHz. With respect to the developing bias voltages in the non-image formation area, the DC bias voltage Vdc is −500 V and the AC bias voltage is off. For the image formation area for forced discharge on the photoreceptor 1, the development is performed at a DC bias voltage which is the same as an AC bias voltage, which is different from that in the image formation area, according to the toner forced discharge program and a toner image for forced discharge is formed. The developing bias voltages are Vdc=−300 to −700 kV and Vacp-p=1.0 to 1.2 kV at Fac=3 to 5 kHz. As an AC bias voltage different from that in the image formation area, an AC bias voltage in which the frequency Fac is lowered by −2 kHz or the peak value Vacp-p is increased by +0.2 kV is used.

On the other hand, the CPU 11 controls so as to convey out a transfer material of a size selected by the operation and display section 40 and the transfer section transfers a toner image formed in the image formation area on the photoreceptor 1 to the transfer material. A toner image in the image formation area for forced discharge on the photoreceptor 1 passes through the transfer section without being transferred, is discharged forcibly, is cleaned by the cleaning device 8 together with toner remaining after transfer, and is collected.

In the toner forced discharge mode of the present invention, reduction in the charging amount when the retention time of toner in the developer container is increased occurs much on the small-particle diameter side, so that a developing bias condition at time of forced discharge is set and deteriorated toner is discharged positively.

Figure 10:
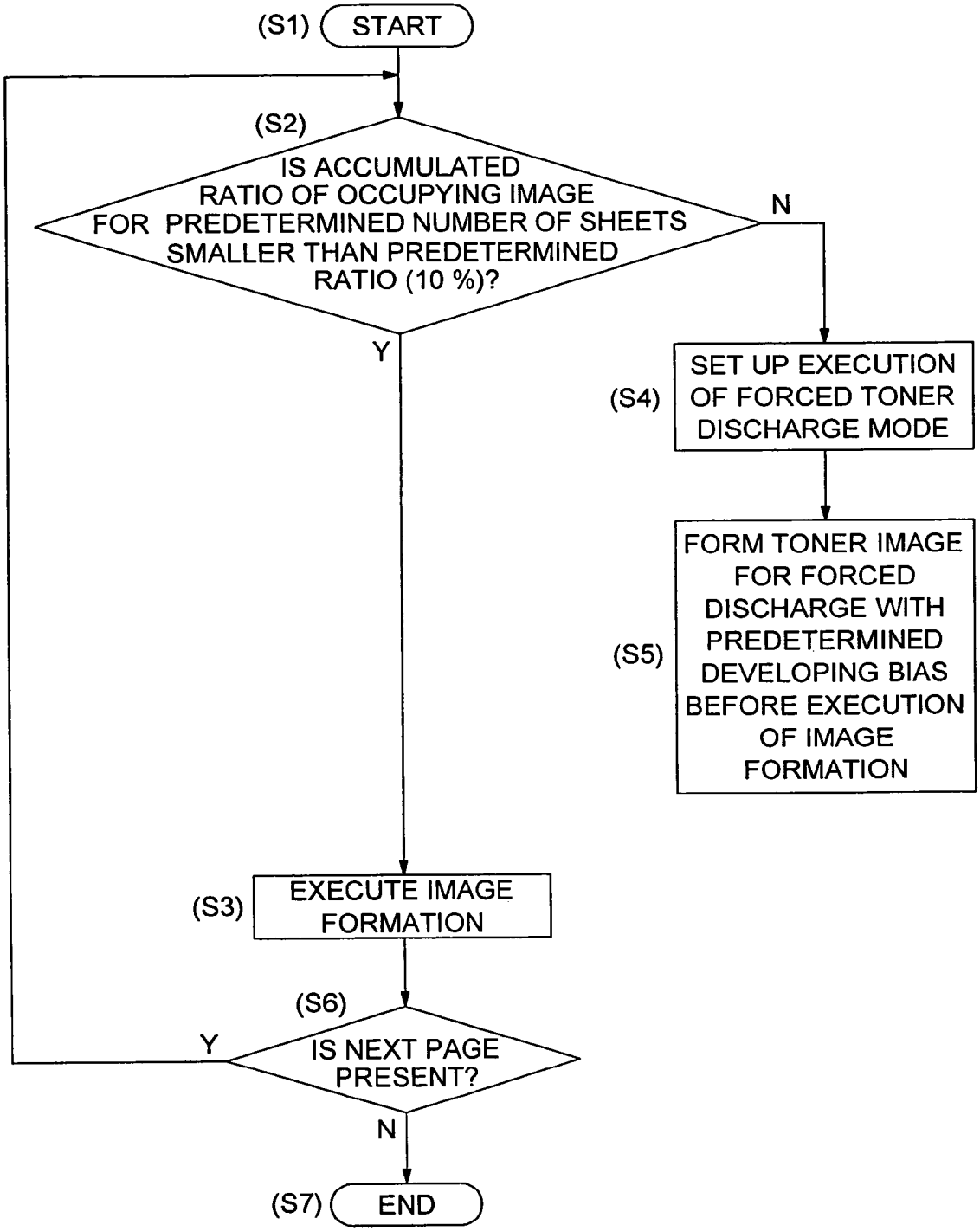
FIG. 10 is a flow chart of control of the toner forced discharge mode.

FIG. 10 shows a flow chart of control for executing the toner forced discharge mode of the present invention. When the start button for instructing start of the image forming operation is pressed and an image forming start signal for starting the image forming operation is input to the controller (Step S1), the CPU of the controller decides whether a preceding predetermined total number of copies, for example, the cumulative ratio of occupying image in printing area of 10 copies is a predetermined rate, for example, less than 10% or not (Step S2). When the cumulative ratio of occupying image in printing area is larger than the predetermined rate, for example, 10% (Y), the ordinary image formation is executed (Step S3). When the cumulative ratio of occupying image in printing area is smaller than the predetermined rate, for example, 10% (N), execution of the toner forced discharge mode is sot (S4). Continuously, an image formation area for forced discharge is provided in the non-image formation area before execution of image formation, and at an AC bias voltage different from that in the image formation area, a toner image for forced discharge is formed in the image formation area for forced discharge, and deteriorated toner is discharged (S5). The image formation area for forced discharge, in this embodiment, may be provided in the non-image formation area on the upstream side of the image formation area, tough it may be provided in the non-image formation area on the downstream side of the image formation area. To the different AC bias voltage, for example, a frequency Fac of 3 kHz lower than that in the image formation area by 2 kHz or a peak value Vacp-p of 1.2 kV higher than that in the image formation area by +0.2 kV is applied. Thereafter, the ordinary image formation is executed in the image formation area (Step S3). After image formation, the CPU decides whether there is a next page available or not (S6) and when there is the next page (Y), the CPU returns to Step S2 and continues the same process as the aforementioned. When there is no next page (N), the CPU finishes the process (S7). According to the aforementioned process, the toner forced discharge mode is executed.

Embodiment 1

The particle diameter distribution of toner consumed by development varies with the frequency Fac (hereinafter, may be referred to simply as Fac) of the AC bias voltage of the developing bias voltage.

Figure 3:
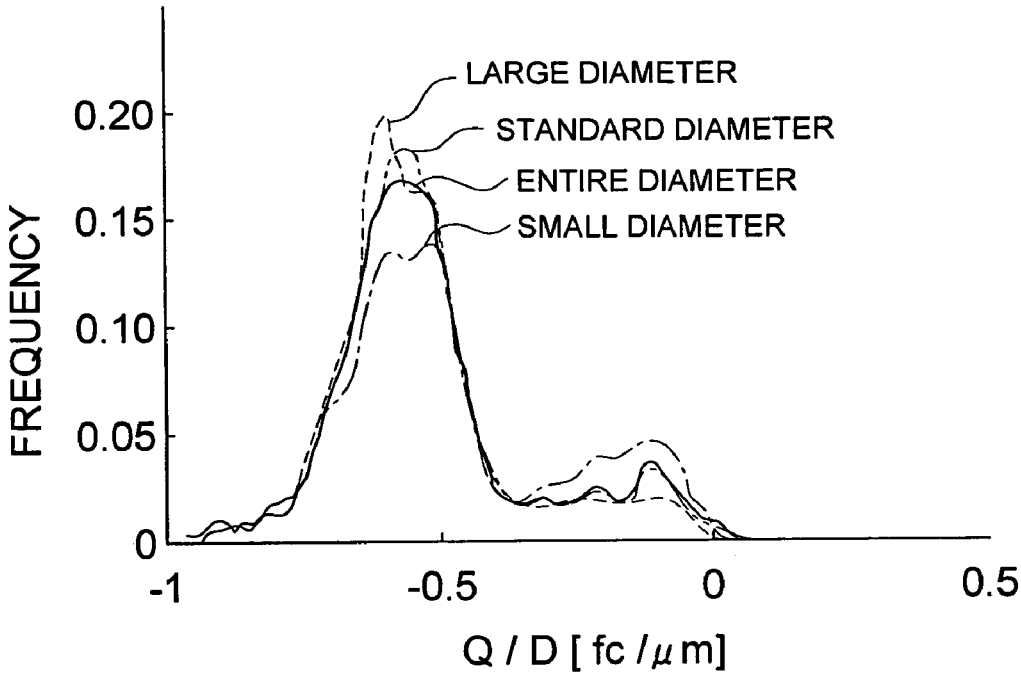
FIG. 3 is graphs showing the toner-Q/D distributions at start time.
Figure 5:
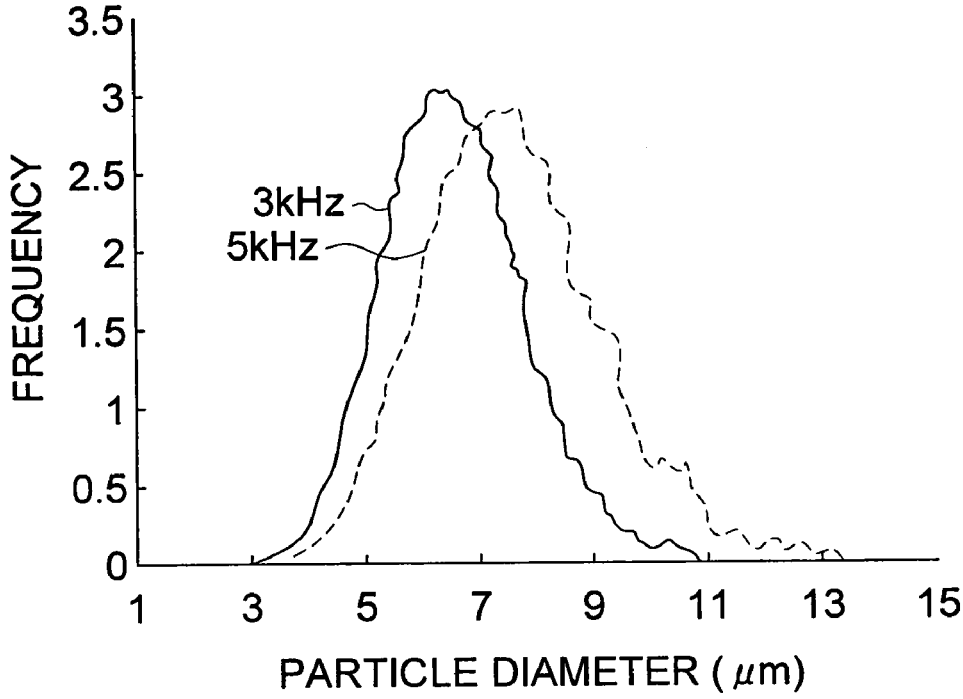
FIG. 5 is graphs showing the toner particle diameter distributions when the F alternating current is changed.

FIG. 5 shows the toner particle diameter distributions developed on the drum when Fac is changed by using the same developer as that shown in FIG. 3 in the image forming apparatus explained in FIG. 1. As clearly shown in FIG. 5, Fac is set at a value lower than that in the image formation area, thus the developed toner particle diameter distributions are moved toward the small-particle diameter side.

In the image formation area, the development is performed at an AC bias voltage at a frequency Fac of 5 kHz and when image formation of many copies in low image coverage is executed, toner consumption is biased on the large particle diameter side and small-particle diameter toner which is deteriorated toner is accumulated in the developer container.

Therefore, in this embodiment, the toner forced discharge mode for discharging toner in the image formation area for forced discharge installed in the non-image formation area other than the image formation area is executed and the accumulated toner is discharged from the developing device. In the toner forced discharge mode, in the image formation area for forced discharge, a latent image of a ratio of occupying image in printing area of 0.95% is formed and is developed by applying an AC bias voltage at a frequency Fac of 3 kHz lower than that in the image formation area to it, and in the toner forced discharge mode, deteriorated toner biased on the small-particle diameter toner side is discharged.

Figure 6:
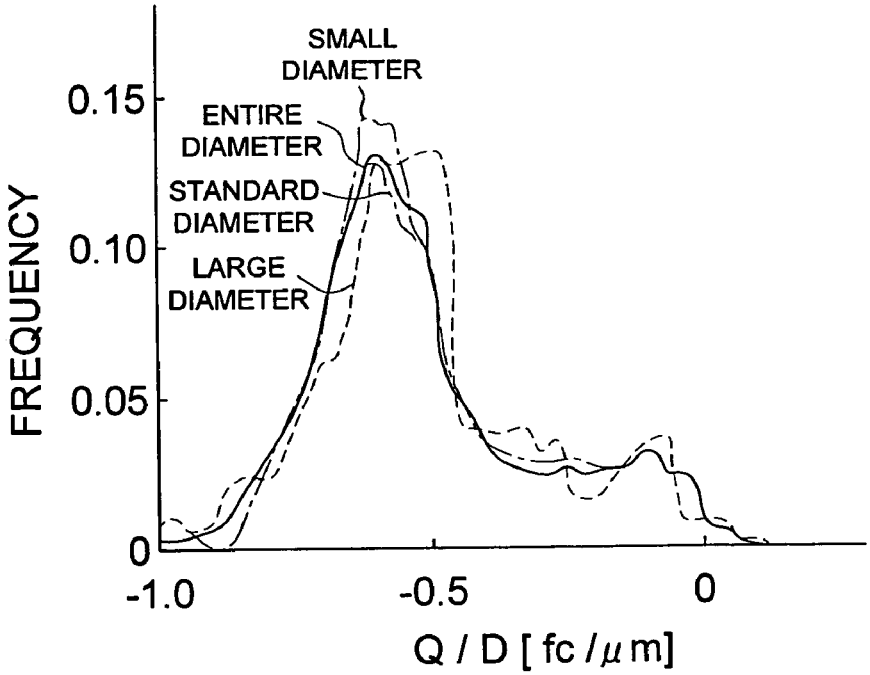
FIG. 6 is graphs showing the Q/D distributions after image formation in low image coverage of Embodiment 1.

FIG. 6 shows the Q/D distribution conditions after printing an image of a ratio of occupying image in printing area of 0.05% in low image coverage 5000 times by executing the toner forced discharge of this embodiment. As clearly shown in the drawing, the Q/D distribution conditions drawn are approximate to the Q/D distribution conditions at start time shown in FIG. 3 and even after image formation of many copies in low image coverage, the satisfactory developing conditions at start time are maintained.

Embodiment 2

Figure 7:
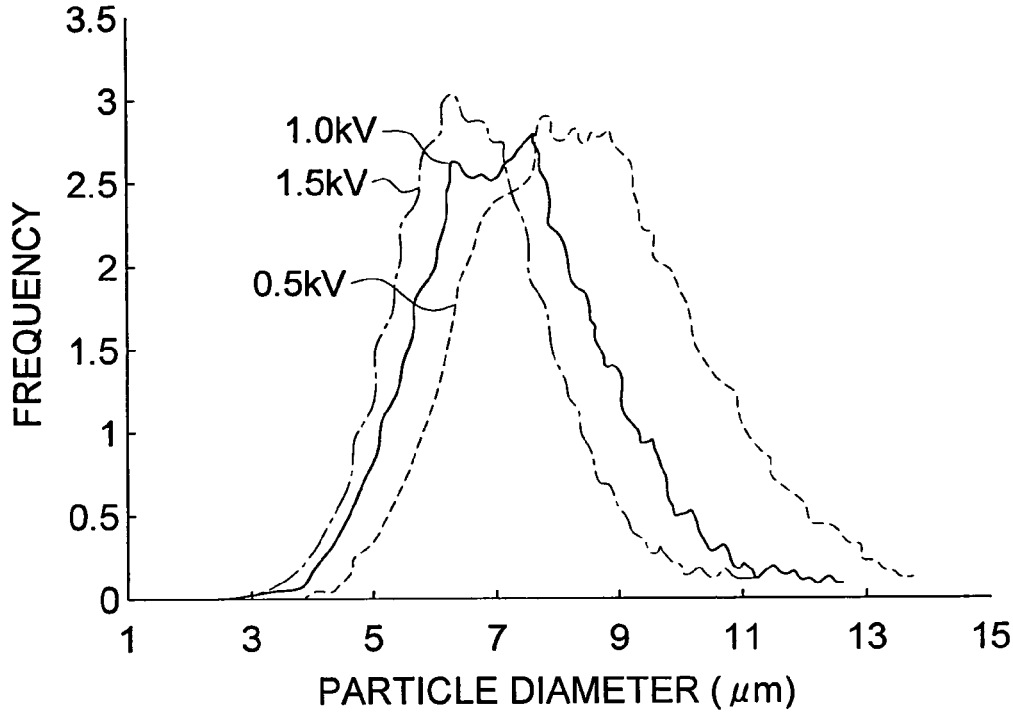
FIG. 7 is graphs showing the toner particle diameter distributions when Vacp-p is changed.

The particle diameter distribution of toner consumed by development depends on the peak value Vacp-p (hereinafter, may be referred to simply as Vacp-p) of the AC bias voltage of the developing bias voltage. FIG. 7 shows the dependence of the toner particle diameter distribution which is developed when Vacp-p is changed by using the image forming apparatus explained in FIG. 1. As clearly shown in FIG. 7, Vacp-p is set higher than that in the image formation area, thus the toner particle diameter distribution developed is shifted toward the small-particle diameter side.

At time of the ordinary image formation, the development is executed at a peak value of Vacp-p of 1.0 kV, and when many images at a small ratio of occupying image in printing area in low image coverage are formed, toner consumption is biased on the large-particle diameter side and small-particle diameter toner which is deteriorated toner is accumulated in the developer container.

Therefore, in this embodiment, at time of image formation, the toner forced discharge mode for forcibly discharging toner in the image formation area for forced discharge provided in the non-image formation area other than the image formation area is executed and deteriorated toner accumulated in the developing device is discharged. In the toner forced discharge mode, in the image formation area for forced discharge other than the image formation area, a latent image of a ratio of occupying image in printing area of 0.95% is formed and is developed by applying an AC bias voltage at a peak value of Vacp-p of 1.3 kV higher than that in the image formation area to it, and in the toner forced discharge mode, deteriorated toner biased on the small-particle diameter toner side is discharged.

Figure 8:
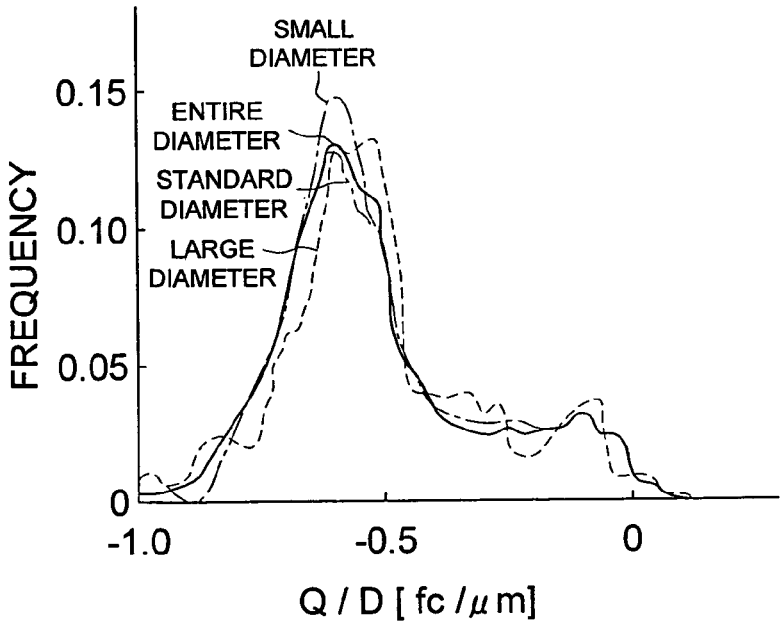
FIG. 8 is graphs showing the Q/D distributions after image formation in low image coverage of Embodiment 2.

FIG. 8 shows the Q/D distribution conditions after printing an image of a ratio of occupying image in printing area of 0.05% 5000 times by executing the toner forced discharge of this example. As clearly shown in FIG. 8, the Q/D distribution conditions drawn are approximate to the Q/D distribution conditions at start time shown in FIG. 3 and even after image formation of many copies in low image coverage, the satisfactory developing conditions at start time are maintained.

To verify the effects of Embodiments 1 and 2 in the present invention, a comparison test with other image forming conditions is executed by Comparison Examples 1 and 2.

Comparison Example 1

This Comparison Example 1, in the image formation area on the photoreceptor 1, forms an electrostatic latent image of a ratio of occupying image in printing area of 0.05% and in the image formation area for forced discharge, forms an electrostatic latent image of a ratio of occupying image in printing area of 0.95%. For development, Comparison Example 1 does not change the developing bias voltage for development in the image formation area even in the toner forced discharge mode for development in the image formation area for forced discharge, maintains the developing bias voltage of Vacp-p=1.0 kV at Fac=5 kHz, executes image formation of printing of 5000 copies, then evaluates the printed images for toner splash and gray background, and measures the Q/D distribution, and the results are shown in FIG. 9.

Figure 9:
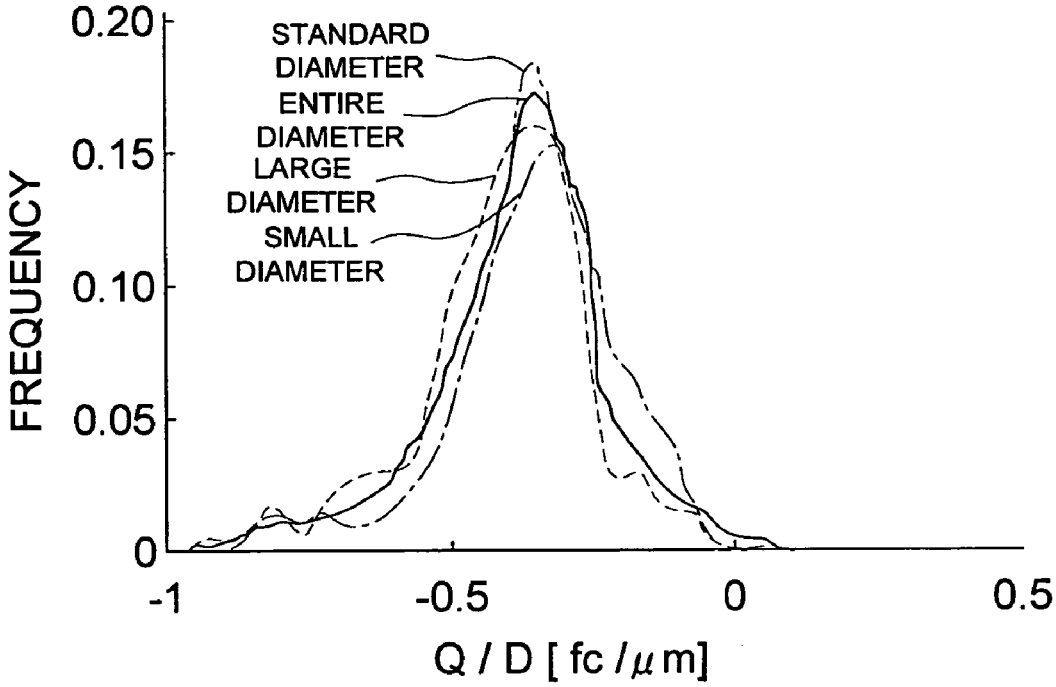
FIG. 9 is graphs showing the Q/D distributions after image formation in low image coverage of Comparison Example 1.

It is found that the Q/D-distribution conditions shown in FIG. 9 are shifted to the low Q/D side compared with the Q/D distributions at start time.

Comparison Example 2

Figure 4:
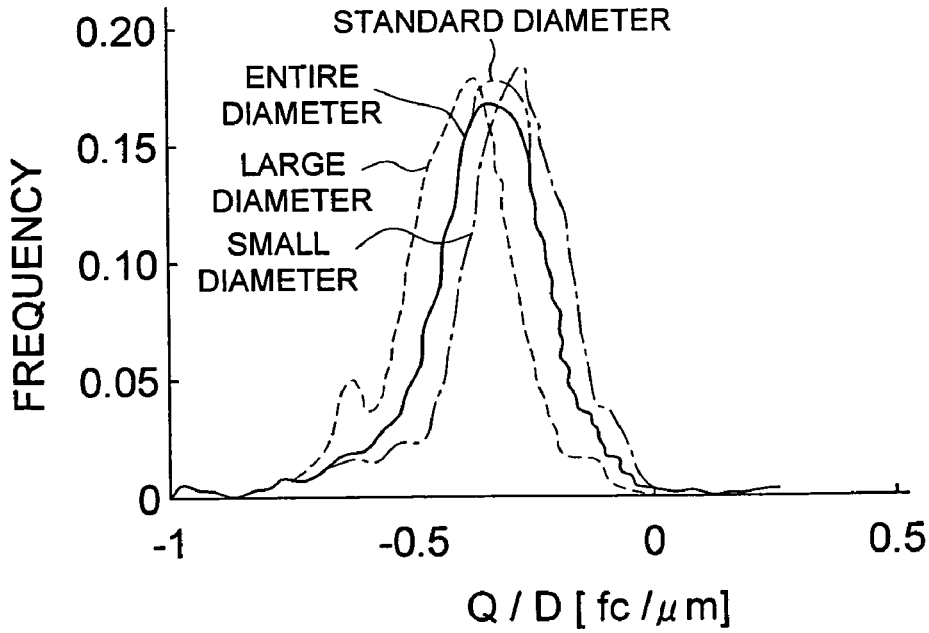
FIG. 4 is graphs showing the Q/D distributions after image formation in low image coverage.

Comparison Example 2 does not execute toner forced discharge but executes only the image formation which is executed conventionally, and in the image formation area on the photoreceptor 1, forms an electrostatic latent image of a ratio of occupying image in printing area of 0.05%, executes image formation of printing of 5000 copies under the developing condition of Vdc=−500 V and Vacp-p=−1.0 kV at Fac=5 kHz, then evaluates the printed images for toner splash and gray background, and measures the Q/D distribution, and the results are those shown in FIG. 4.

It is recognized that the Q/D distribution conditions shown in FIG. 4 are more shifted to the low Q/D side compared with the Q/D distributions shown in FIG. 9 of Comparison Example 1 and the Q/D distributions are diffused.

For Embodiments 1 and 2 and Comparison Examples 1 and 2, occurrence conditions of toner splash around the developing device and gray background of coated paper are evaluated visually and the results are given in Table 1. With respect to the evaluation of gray background of the coated paper given in Table 1, the gray background is measured by an image densitometer, and gray background free of practical trouble is indicated by A, and practically questionable gray background is indicated by B, and furthermore, each measured value of the image densitometer is put in parentheses. In Embodiments 1 and 2, good gray background appears and it is not practically trouble, though in Comparison Examples 1 and 2, remarkable gray background appears and it is practically questionable.

TABLE 1

| | Forced discharge | Peak value Vacp-p Image formation area, image formation area for forced discharge | Frequency Fac Image formation area, image formation area for forced discharge | Toner splash | *1 | *2 |
|---|---|---|---|---|---|---|
| Embodiment 1 | Yes | 1.0 kV/1.0 kV | 5 kV/3 kV | No | A (0.002) | FIG. 6 |
| Embodiment 2 | Yes | 1.0 kV/1.3 kV | 5 kV/5 kV | No | A (0.004) | FIG. 8 |
| Comparison Example 1 | No | 1.0 kV/1.0 kV | 5 kV/5 kV | No | B (0.007) | FIG. 9 |
| Comparison Example 2 | No | 1.0 kV/OFF | 5 kV/OFF | Yes | B (0.010) | — |

*1: Gray background of coated paper,
*2: Charging amount distribution

Further, the reason that coated paper is used for evaluation of gray background in Table 1 is that coated paper has a good surface property, thus gray background toner is easily transferred, and toner after fixing hardly soaks into the paper, thereby spreads out on the surface of the coated paper, so that conspicuous gray background appears compared with plain paper, thus the gray background is evaluated easily.

According to at least an embodiment of the present invention, when a reduction in the charging amount of toner occurs due to stress caused by stirring in the developer container, by applying an AC bias voltage at a lower frequency than that in the image formation area at time of forced discharge or applying an AC bias voltage at a higher peak value than that in the image formation area, small-particle diameter toner remarkably reduced in the charging amount may be discharged selectively and excessive discharge of toner may be prevented. Therefore, satisfactory image formation may be executed.

While the preferred embodiments of the present invention have been described using specific terms, such description is for illustrative purposes only, and it is to be understood that changes and variations may be made without departing from the spirit or scope of the appended claims. The presently disclosed embodiments are therefore to be considered in all respects as illustrative and not restrictive, and all changes which come within the meaning and range of equivalency of the claims are therefore intended to be embraced therein.

What is claimed is:

1. An image forming apparatus comprising:

(a) a photoreceptor which forms an electrostatic latent image thereon;

(b) a developing device which applies a developing bias voltage obtained by superimposing an AC bias voltage onto a DC bias voltage to the photoreceptor, and develops the latent image on the photoreceptor with a two-component developer to form a toner image;

(c) a controller for controlling the developing bias voltage;

(d) a transfer device for transferring the toner image onto a transfer material;

(e) a fixing device for fixing the toner image on the transfer material; and (f) a cleaning device for collecting and cleaning a toner on a surface of the photoreceptor, wherein the image forming apparatus provides a toner forced discharge mode for forming a toner image for forced discharge in a first image formation area provided in a non-image formation area other than a second image formation area on the photoreceptor to forcibly discharge a toner from the developing device, and when the toner forced discharge mode is selected, an AC bias voltage at a frequency lower than that in the second image formation area is applied to the first image formation area for forced discharge to develop a latent image for forced discharge, thereby a toner image for forced discharge is formed, and a toner of the toner image for forced discharge is collected by the cleaning device.

2. The image forming apparatus of claim 1, wherein the toner forced discharge mode is executed when a cumulative ratio of occupying image in a printing area is equal to or less than a predetermined ratio.

3. The image forming apparatus of claim 1, wherein a value of the DC bias voltage to be applied for the second image formation area is the same as that for the first image formation area for forced discharge provided in the non-image formation area.

4. The image forming apparatus of claim 1, wherein a developing bias voltage in which an AC bias voltage is superimposed onto a DC bias voltage, is applied to the second image formation area, and a DC bias voltage only is applied to the non-image formation area without applying an AC bias voltage.

5. The image forming apparatus of claim 1, wherein the forced discharge of the toner from the developing device is executed by cleaning and collecting a toner image for the forced discharge on the photoreceptor without transferring the toner image onto the transfer material.

6. The image forming apparatus of claim 1, wherein the latent image for forced discharge is formed by imagewise exposing an image for forced discharge on the photoreceptor with laser light.

7. The image forming apparatus of claim 1, wherein a frequency of the AC bias voltage to be applied to the second image formation area is 5 to 7 kHz.

8. The image forming apparatus of claim 1, wherein the two-component developer is composed of a toner and a carrier and the toner is composed of a colored resin particle and an external additive.

9. An image forming apparatus comprising:

(a) a photoreceptor which forms an electrostatic latent image thereon;

(b) a developing device which applies a developing bias voltage obtained by superimposing an AC bias voltage onto a DC bias voltage to the photoreceptor, and develops the latent image on the photoreceptor with a two-component developer to form a toner image;

(c) a controller for controlling the developing bias voltage;

(d) a transfer device for transferring the toner image onto a transfer material;

(e) a fixing device for fixing the toner image on the transfer material; and (f) a cleaning device for collecting and cleaning the toner on a surface of the photoreceptor, wherein there is provided a toner forced discharge mode for forming a toner image for forced discharge in a first image formation area provided in a non-image formation area other than a second image formation area on the photoreceptor to forcibly discharge a toner from the developing device, and when the toner forced discharge mode is selected, an AC bias voltage at a peak value higher than that in the second image formation area is applied to the first image formation area for forced discharge to develop a latent image for forced discharge, thereby a toner image for forced discharge is formed, and a toner of the toner image is collected by the cleaning device.

10. The image forming apparatus of claim 9, wherein the toner forced discharge mode is executed when a cumulative ratio of occupying image in a printing area is equal to or less than a predetermined ratio.

11. The image forming apparatus of claim 9, wherein a value of the DC bias voltage to be applied for the second image formation area is the same as that for the first image formation area for forced discharge provided in the non-image formation area.

12. The image forming apparatus of claim 9, wherein a developing bias voltage in which an AC bias voltage is superimposed onto a DC bias voltage, is applied to the second image formation area, and a DC bias voltage only is applied to the non-image formation area without applying an AC bias voltage.

13. The image forming apparatus of claim 9, wherein the forced discharge of the toner from the developing device is executed by cleaning and collecting a toner image for forced discharge on the photoreceptor without transferring the toner image onto the transfer material.

14. The image forming apparatus of claim 9, wherein the latent image for forced discharge is formed by imagewise exposing an image for forced discharged on the photoreceptor with laser light.

15. The image forming apparatus of claim 9, wherein a peak value of the AC bias voltage to be applied to the second image formation area is 0.8 to 1.0 kV.

16. The image forming apparatus of claim 9, wherein the two-component developer is composed of a toner and a carrier and the toner is composed of a colored resin particle and an external additive.

* * * * *